US010702104B2

(12) United States Patent
Ramirez et al.

(10) Patent No.: US 10,702,104 B2
(45) Date of Patent: Jul. 7, 2020

(54) FREESTANDING, PORTABLE RAISED TUB FOR INFANTS, TODDLERS AND YOUNG CHILDREN

(71) Applicants: Kenobi Ramirez, Passaic, NJ (US); Ronnie Villalobos, Passaic, NJ (US); Martin Cespedes, Hopatcong, NJ (US)

(72) Inventors: Kenobi Ramirez, Passaic, NJ (US); Ronnie Villalobos, Passaic, NJ (US); Martin Cespedes, Hopatcong, NJ (US)

(73) Assignee: Kenobi Ramirez, Passaic, NJ (US)

( * ) Notice: Subject to any disclaimer, the term of this patent is extended or adjusted under 35 U.S.C. 154(b) by 0 days.

(21) Appl. No.: 16/135,072

(22) Filed: Sep. 19, 2018

(65) Prior Publication Data

US 2019/0082896 A1 Mar. 21, 2019

Related U.S. Application Data

(60) Provisional application No. 62/560,406, filed on Sep. 19, 2017.

(51) Int. Cl.

| | |
|---|---|
| ***A47K 3/024*** | (2006.01) |
| ***A47K 3/06*** | (2006.01) |
| ***A47K 3/03*** | (2006.01) |
| ***A47K 3/17*** | (2006.01) |

(52) U.S. Cl.

CPC ..... *A47K 3/024* (2013.01); *A47K 3/03* (2013.01); *A47K 3/06* (2013.01); *A47K 3/17* (2013.01)

(58) Field of Classification Search

CPC ..... A47K 3/024

USPC ..... 4/645

See application file for complete search history.

(56) References Cited

U.S. PATENT DOCUMENTS

| | | | | | |
|---|---|---|---|---|---|
| 1,658,944 | A | * | 2/1928 | Schaeffer | A47K 3/064 4/572.1 |
| 2,085,901 | A | * | 7/1937 | De Puy | A47K 3/164 4/551 |
| 2,715,736 | A | * | 8/1955 | Raymond | A47D 5/003 4/551 |
| 2,751,603 | A | * | 6/1956 | Brinkman | A47K 3/164 4/551 |
| 3,094,711 | A | * | 6/1963 | Kentes | A47K 3/064 4/550 |
| 3,995,331 | A | * | 12/1976 | Fotre | A47K 3/064 4/572.1 |
| 4,302,857 | A | | 12/1981 | Kodet et al. | |
| 5,014,371 | A | * | 5/1991 | Heel | A45D 19/04 4/516 |

(Continued)

FOREIGN PATENT DOCUMENTS

EP 1783322 A1 5/2007

*Primary Examiner* — Lori L Baker

(74) *Attorney, Agent, or Firm* — Budzyn IP Law, LLC

(57) ABSTRACT

In one aspect, a freestanding, portable raised tub for infants, toddlers and young children is provided herein which includes: a basin with a base and an upstanding side wall bounding the base; a plurality of legs secured to the basin; a rigid panel pivotably connected to the basin so as to be angularly adjustable relative thereto; and, an adjustable guard pivotably connected to the rigid panel so as to be angularly adjustable relative thereto, the guard extending continuously from a first location on the rigid panel to a second location on the rigid panel, the first and second locations being spaced apart.

6 Claims, 7 Drawing Sheets

(56) References Cited

U.S. PATENT DOCUMENTS

| | | | | | |
|---|---|---|---|---|---|
| 5,313,676 | A * | 5/1994 | Wright | A47K 1/02 | 4/631 |
| 5,425,149 | A | 6/1995 | Crossley et al. | | |
| 5,678,255 | A * | 10/1997 | Stoudamire, Sr. | A45D 19/04 | 4/516 |
| 5,813,063 | A * | 9/1998 | Watkins | E03C 1/18 | 4/626 |
| 7,032,259 | B1 * | 4/2006 | Kilion | A47K 3/064 | 220/629 |
| 7,305,724 | B2 * | 12/2007 | Rozental | A47K 3/074 | 4/572.1 |
| 8,117,689 | B2 * | 2/2012 | Slayton | A47K 1/02 | 4/516 |
| 8,302,218 | B2 | 11/2012 | Dignitti et al. | | |
| 2002/0066141 | A1 * | 6/2002 | Diaz Rivera | A47K 1/02 | 4/645 |
| 2012/0184401 | A1 * | 7/2012 | Shepherd | A63B 63/083 | 473/481 |

* cited by examiner 40
42
16
44
20
60
18
60
12
24
Top view
(Wide open)

40
40B
44
16
12
40C
40A
42
Front view
(Raised bar handle)

40
42
38
12
64
Side view
(Raised bar handle)

40
42
16
12
44
Back view
(Raised bar handle)

42
16
46
44
40B
40A
40
40C
20
12
Top view
(Down bar handle)

16
40
12
Front view
(Down bar handle)

40
46
16
42
12
64
38
Side view
(Down bar handle)

16
42
12
44
Back view
(Down bar handle)

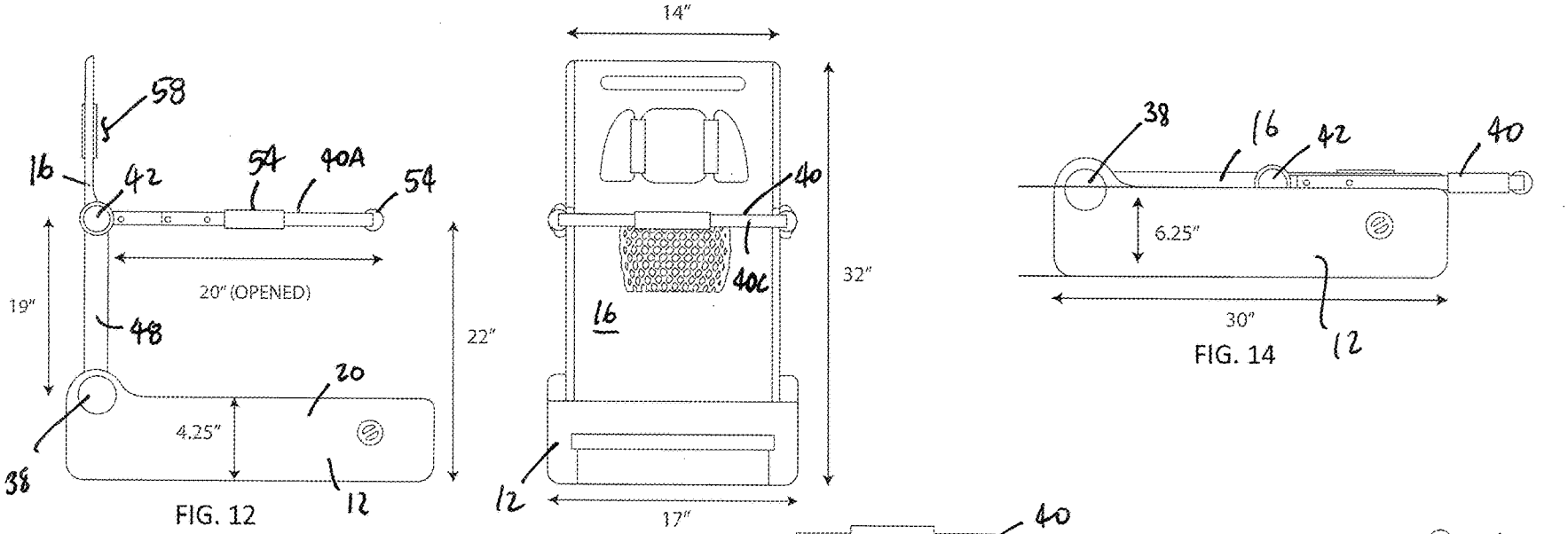
FIG. 14
FIG. 13
FIG. 12
FIG. 15
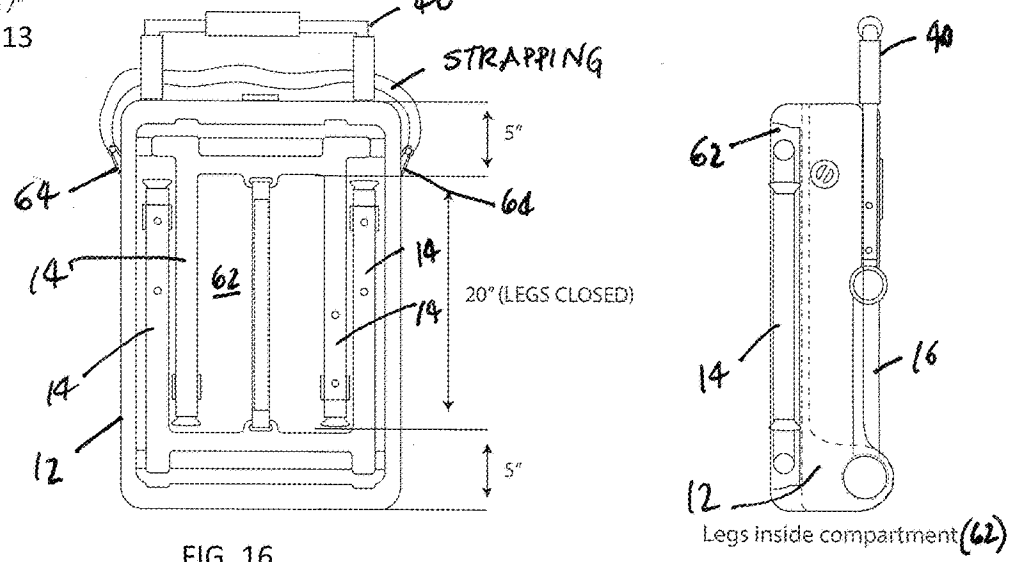
FIG. 17
FIG. 16

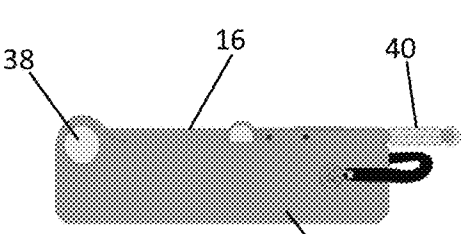
FIG. 19
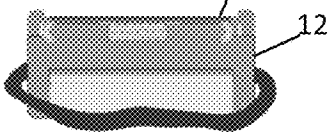
FIG. 20
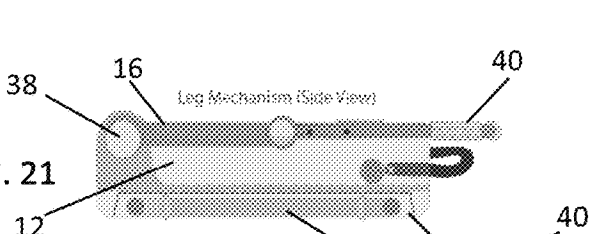
FIG. 21
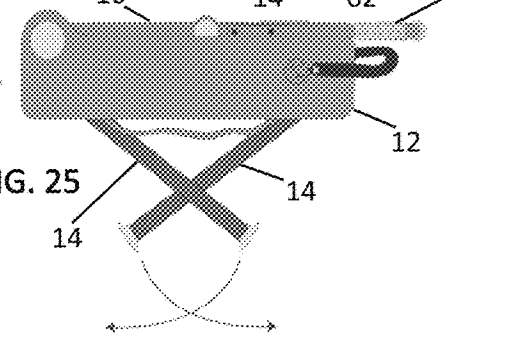
FIG. 25
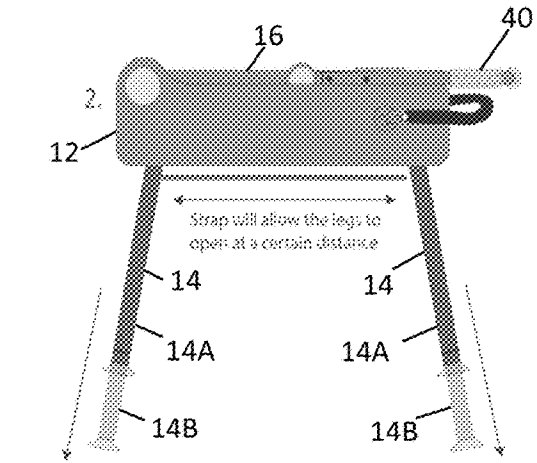
FIG. 27
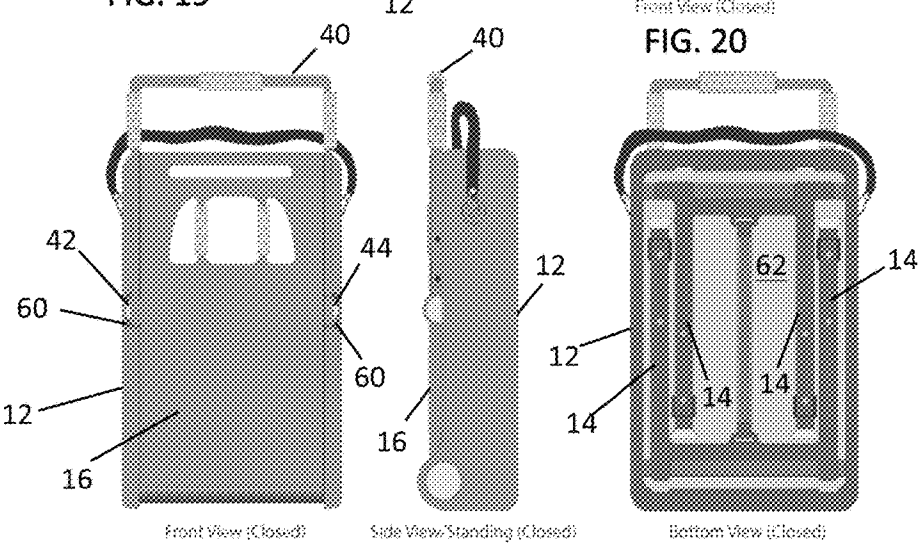
FIG. 24
FIG. 23
FIG. 22
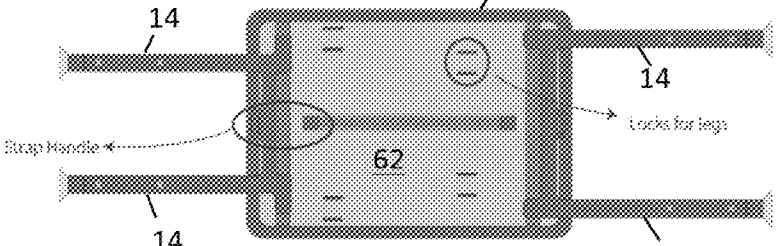
FIG. 26

MULTIPURPOSE BATH TUB DESIGN

AGES: Birth to 6 months

AGES: 6 to 12 months

AGES: 1 to 4 years

FREESTANDING, PORTABLE RAISED TUB FOR INFANTS, TODDLERS AND YOUNG CHILDREN

CROSS-REFERENCE TO RELATED APPLICATION

This application claims priority to U.S. Provisional Patent Application No. 62/560,406 filed Sep. 19, 2017, the contents of which are incorporated by reference herein.

Freestanding, portable raised tubs for infants, toddlers and young children are known in the prior art. U.S. Pat. No. 2,085,901 to De Puy et al. and U.S. Pat. No. 2,751,603 to Brinkman each depict freestanding, foldable raised tubs made of flexible materials. U.S. Pat. No. 7,032,259 depicts a freestanding, portable tub having a rigid basin and foldable, height-adjustable legs.

Safety is an issue with bathing young children. A child falling out of a raised tub is a concern. U.S. Pat. Nos. 2,085,901 and 2,751,603 both include a hinged side panel configured to be laid atop the basin to act as a dressing table. However, these side panels are of flexible material. The ability to hold the weight of a toddler or small child falling out of the basin is unclear. Moreover, three of the sides of these tubs are open, and the height of these tubs is not adjustable.

SUMMARY OF THE INVENTION

In one aspect, a freestanding, portable raised tub for infants, toddlers and young children is provided herein which includes: a basin with a base and an upstanding side wall bounding the base; a plurality of legs secured to the basin; a rigid panel pivotably connected to the basin so as to be angularly adjustable relative thereto; and, an adjustable guard pivotably connected to the rigid panel so as to be angularly adjustable relative thereto, the guard extending continuously from a first location on the rigid panel to a second location on the rigid panel, the first and second locations being spaced apart.

In a further aspect, a freestanding, portable raised tub for infants, toddlers and young children is provided which includes: a basin with a base and an upstanding side wall bounding the base; a plurality of height-adjustable legs secured to the basin; and, a rigid panel pivotably connected to the basin so as to be angularly adjustable relative thereto to one or more fixed angular positions above the upstanding side wall.

These and other aspects of the invention will be better understood through a study of the following detailed description and accompanying drawings.

BRIEF DESCRIPTION OF THE DRAWINGS

FIGS. 4-13 show different views of an adjustable guard in various positions relative to a rigid panel, in accordance with the subject invention.

FIGS. 14, 16, 17, and 19-24 show different views of the subject invention in a stowed state.

FIGS. 15, 25, and 26 show extension of the legs from the basin with the subject invention preparing for, or being taken from, a stowed state.

FIG. 27 shows height adjustment of the legs useable with the subject invention.

DETAILED DESCRIPTION OF THE INVENTION

Figure 2:
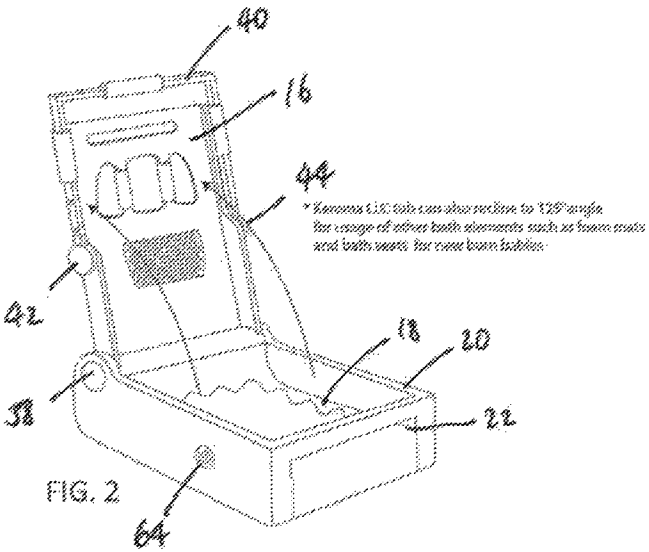
FIGS. 2-3 show a basin and rigid panel in accordance with the subject invention with the rigid panel being in various angular positions relative to the basin.
Figure 3:
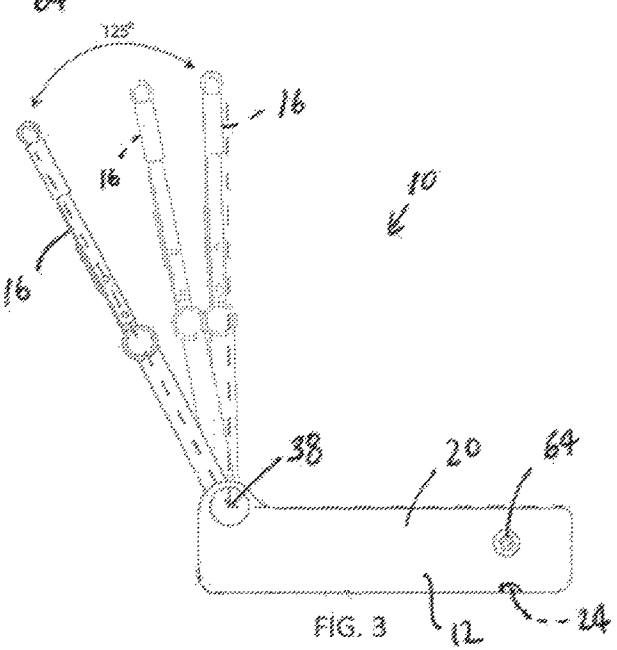
Figure 1:
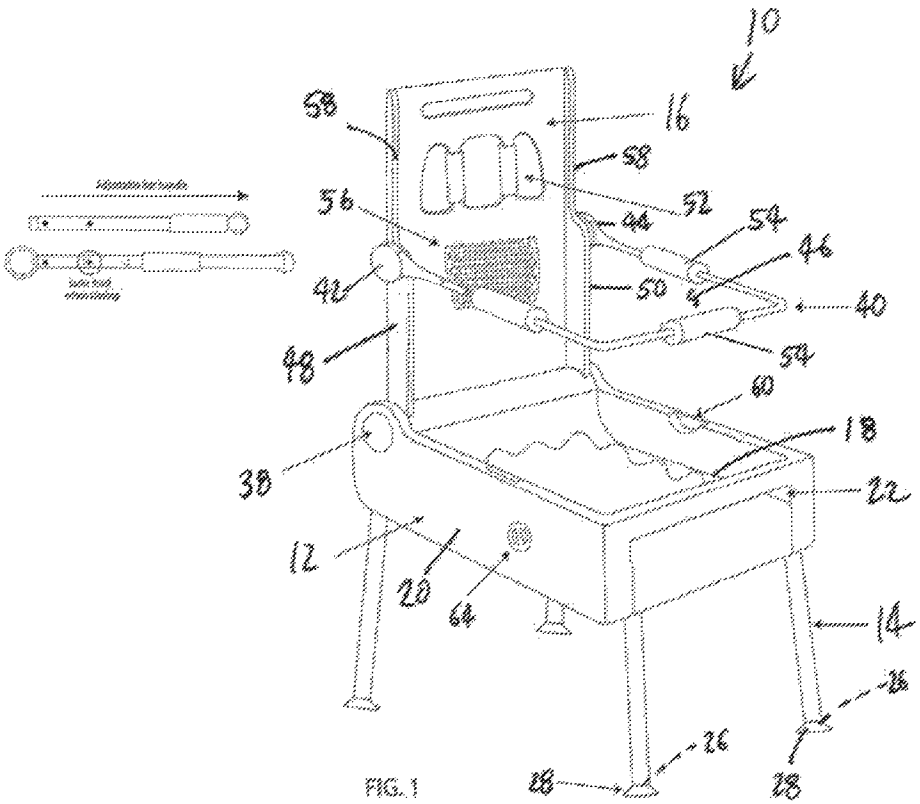
FIG. 1 is a perspective view of a raised tub formed in accordance with the subject invention.
Figures 4, 5, 6, 7, 8, 9, 10, 11:
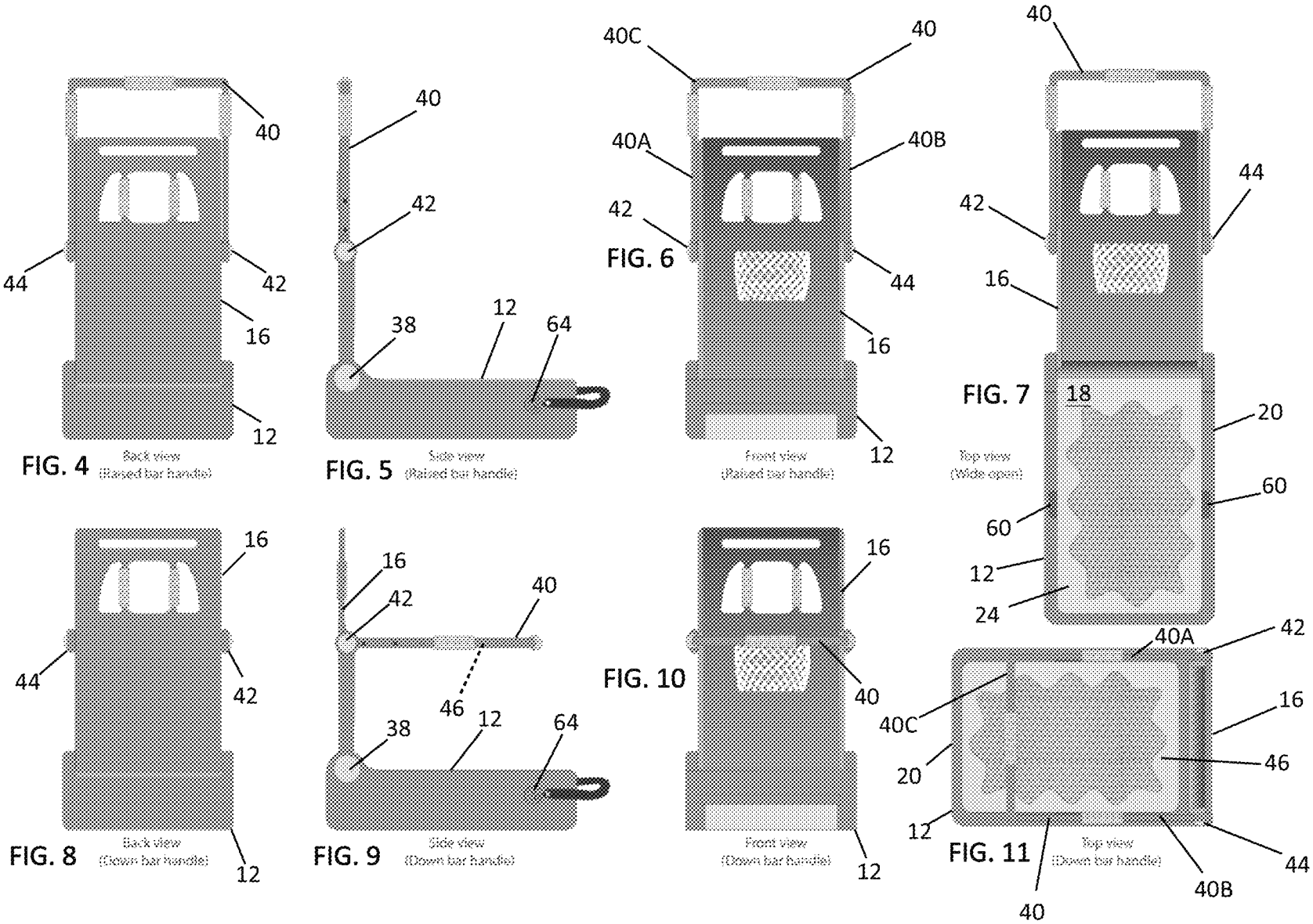
Figure 18A:
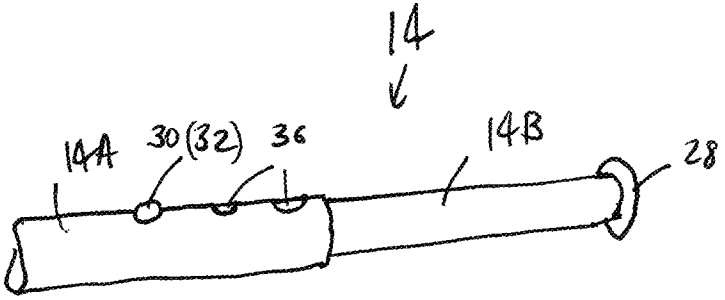
FIGS. 18A and 18B show a possible locking arrangement useable with the legs of the subject invention.
Figure 18B:
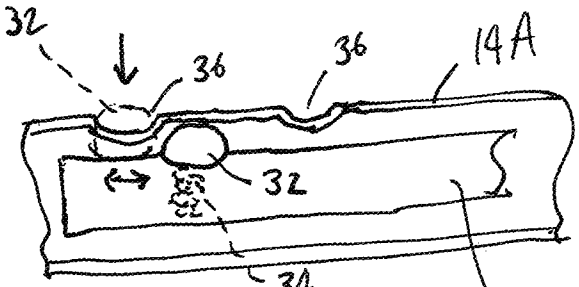
Figure 18:
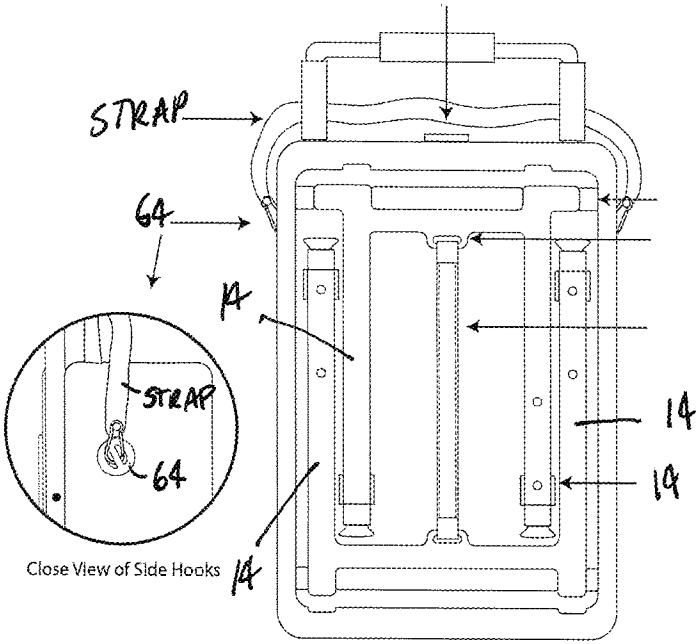
FIG. 18 shows a strap useable with the subject invention.
Figure 31:
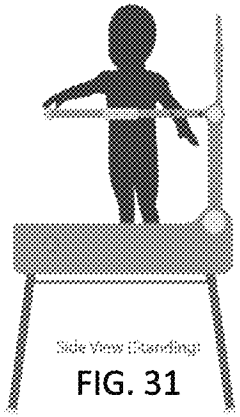
FIGS. 28-34 show the subject invention in use.
Figure 30:
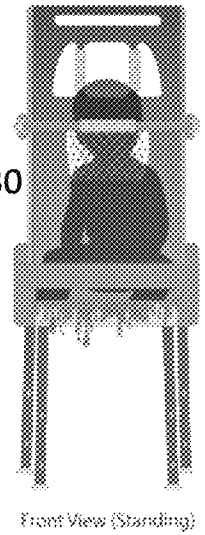
Figure 29:
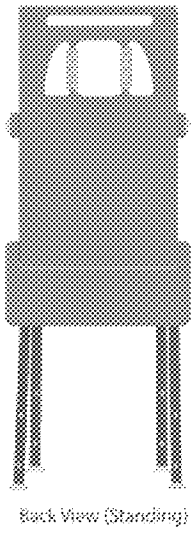
Figure 34:
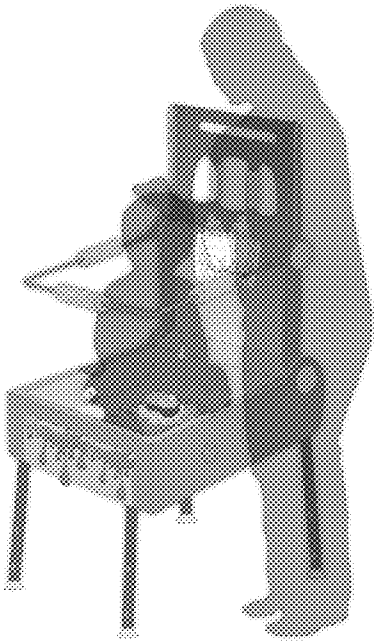
Figure 33:
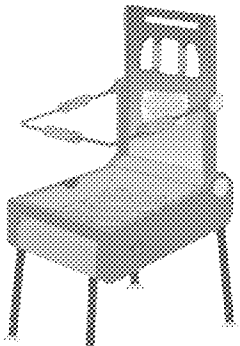
Figure 32:
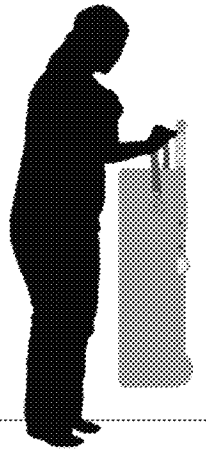
Figure 28:
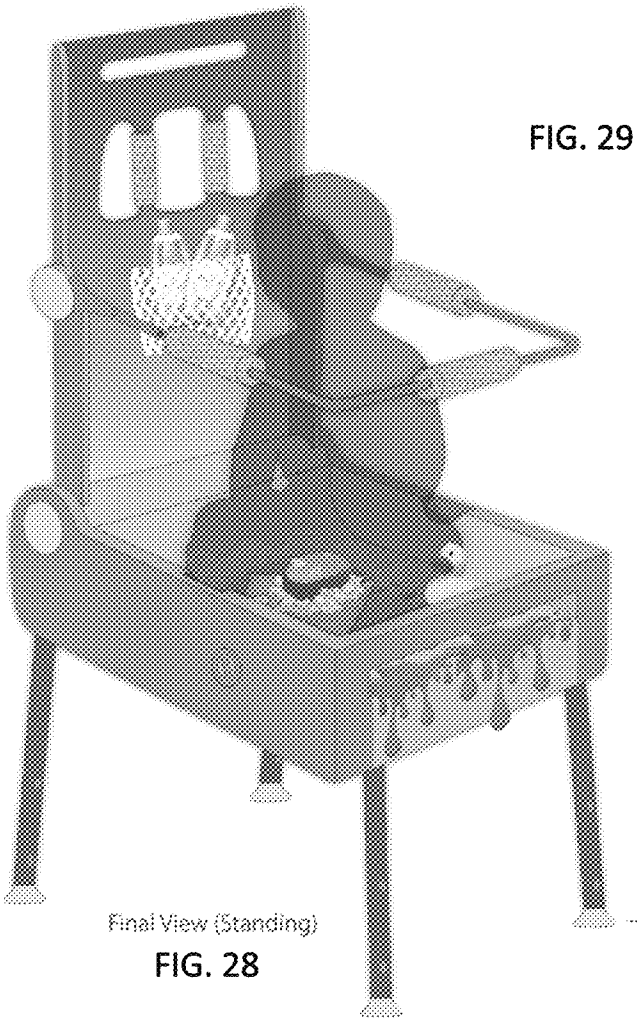
Figure 35:
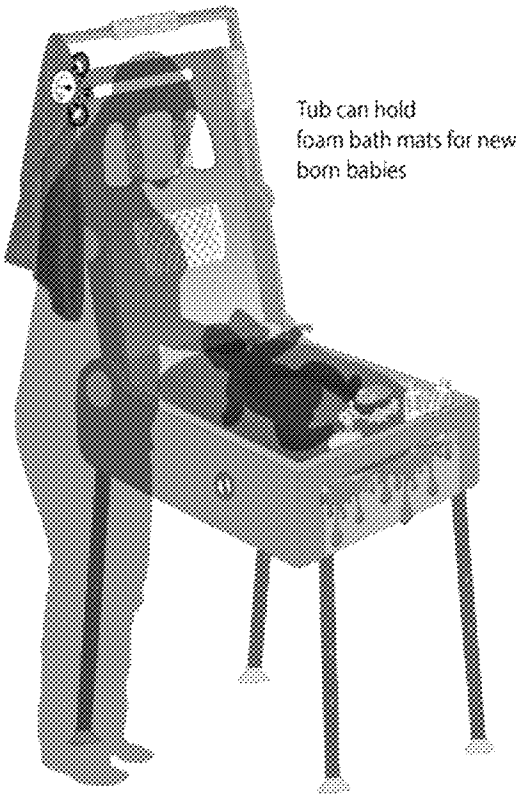
FIGS. 35-37 show configurations of the subject invention for different year groups.
Figure 36:
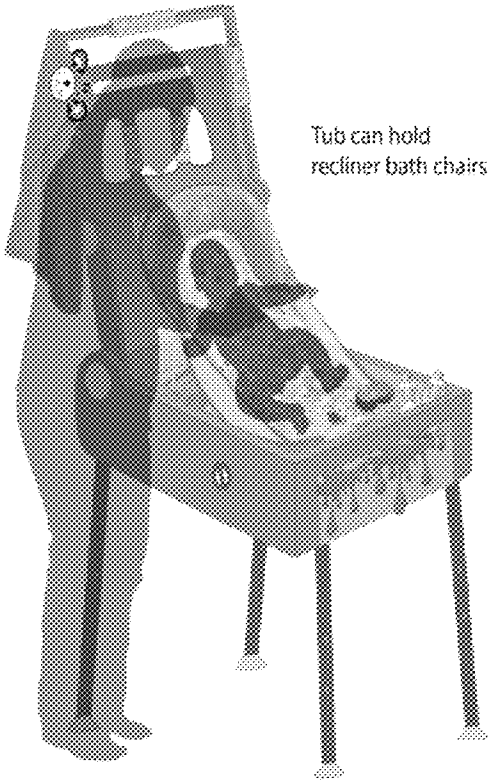
Figure 37:
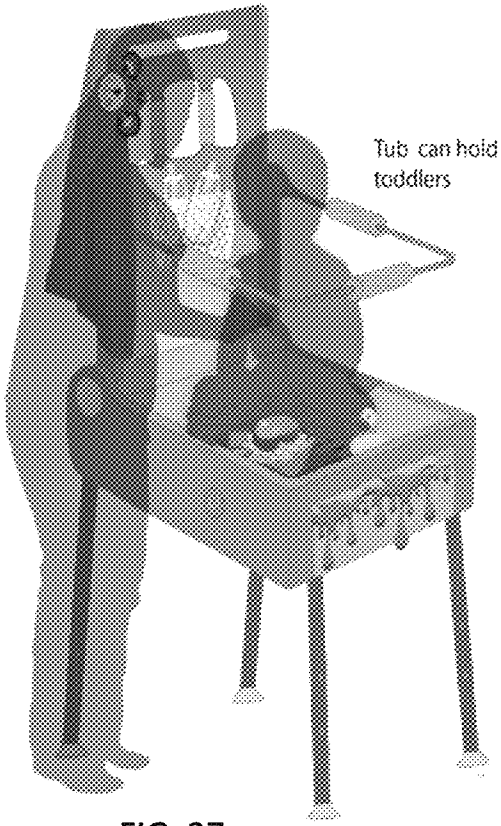

With reference to the Figures, a freestanding, portable raised tub 10 is shown. The tub 10 generally includes a basin 12, a plurality of legs 14 and a rigid panel 16. The tub 10 is sized for use with infants, toddlers and young children. With the tub 10 being raised and portable, the tub 10 eases the bathing process for an adult of an infant, toddler or young child, particularly without the need for kneeling or bending over a bathtub.

The basin 12 includes a base 18 and an upstanding side wall 20 generally bounding the base 18. The basin 12 may be of various shapes including being generally rectangular with the side wall 20 being defined by a plurality of joined straight sections. The basin 12 is formed watertight so as to contain water therein. An overflow opening 22 may be formed in one or more portions of the side wall 20 through which excess water may flow. The excess water may result from overfilling the basin 12, particularly with the water level being raised with an infant, toddler or child placed into the basin 12. After bathing, the overflow opening 22 may be used as a drain with the basin 12 being tilted to cause water to flow through the overflow opening 22. In addition, or alternatively, one or more closable drains 24 may be provided which may be unplugged to allow for draining of the basin. The drain(s) 24 may be located at low-points in the basin 12 (e.g., in the base 18) to allow water to drain under gravitational effects. The basin 12 is preferably unitary and is preferably formed of thermoplastic material.

The legs 14 are of sufficiently robust structure to support the weight of any young child, preferably, with several factors of safety. Preferably, four of the legs 14 are provided. With the basin 12 being rectangular, the four legs 14 are preferably located to coincide with the four corners of the basin 12. The legs 14 are preferably of non-rusting material, such as stainless steel, aluminum or thermoplastic. The legs 14 each terminate in a foot 26. The feet 26 are preferably each provided with a friction-enhancing cover 28, such as a rubber cap or suction cup. Also, the legs 14 are preferably splayed to provide stability. In addition, it is preferred that the feet 26 are located to press against the walls of a bathtub while resting on the base of the bathtub; this provides additional stability.

The legs 14 are preferably height adjustable. Any height adjustable arrangement may be utilized. By way of non-limiting example, each of the legs 14 may include telescoping leg portions 14A, 14B where the overall height of the legs 14 may be adjusted with telescoping adjustment of the leg portions 14A, 14B. In addition, it is preferred that a locking arrangement 30 be provided for each of the legs 14 to releasably lock the leg portions 14A, 14B in various positions. This arrangement allows for the leg portions 14A, 14B to be releasably locked in various positions to allow for the height of the legs 14 to be adjusted. The locking arrangement 30 may include locking element 32 urged by a biasing element 34 (e.g., a spring) to extend through a series of axially-alignable locking apertures 36 formed in the leg portion 14A. With depression of the locking element 32 against force of the biasing element 34, the locking element 32 may be urged inside of the leg portion 14A allowing the leg portions 14A, 14B to be telescopically adjusted. With one of the locking apertures 36 of the leg portion 14A being aligned with the locking element 32, under force of the biasing element 34, the locking element 32 is urged to extend into the corresponding locking aperture 36 thereby resisting telescoping adjustment of the leg portions 14A, 14B. It is preferred that the legs 14 be adjustable to have a height in the range of 20-36 inches.

The rigid panel 16 is pivotably mounted to the basin 12, preferably to a portion of the side wall 20. More preferably, the rigid panel 16 is generally coextensive with one straight portion of the side wall 20. The rigid panel 16 is generally formed of thermoplastic and is sufficiently robust to support a toddler or young child falling out of the basin 12. Preferably, a pivot mounting 38 is provided along one edge of the rigid panel 16 which defines the pivot connection between the rigid panel 16 and the basin 12 and which defines an axis of rotation of the rigid panel 16. Additionally, it is preferred that the pivot mounting 38 include releasably fixed positions for releasably holding the rigid panel 16 in one or more angular positions relative to the basin 12. The pivot mounting 38 may include a ratchet type of releasable locking arrangement.

As an additional level of safety, an adjustable guard 40 may be provided pivotably connected to the rigid panel 16 so as to be angularly adjustable relative thereto. Preferably, the guard 40 extends continuously from a first location 42 on the rigid panel 16 to a second location 44 on the rigid panel 16 with the first and second locations 42, 44 being spaced apart. With this arrangement, the guard 40, along with the rigid panel 16 bounds a safety area 46 located above the basin 12. Preferably, the safety area 46 is sufficiently sized to allow a toddler or young child to stand on the base 18 of the basin 12 and within the safety area 46 using the guard 40 as support. It is also preferred that the safety area 46 be sized to generally overlay the base so as to minimize a toddler's or young child's ability to stand on the basin 12 and be outside the safety area 46. The first and second locations 42, 44 may be located on opposing edges 48, 50 of the rigid panel 16 spaced from the pivot mounting 38. Preferably, the first and second locations 42, 44 are located in the range of 12-48 inches from the pivot mounting 38. The first and second locations 42, 44 may define the pivot connections between the guard 40 and the rigid panel 16. Preferably, the pivot connections are angularly adjustable to fixed positions for maintaining the guard 40 in releasable fixed positions. The pivot connections may include a ratchet type of releasable locking arrangement By way of non-limiting example, the guard 40 may be U-shaped, defined by three generally straight sections. Two side sections 40A, 40B of the guard 40 extend from the first and second locations 42, 44, and are connected to a third, crosspiece section 40C. The side sections 40A, 40B, may be provided to be length adjustable to fixed positions in the same manner as the legs 14 described above. It is preferred that the guard 40 may encompass a safety area 46 generally coextensive with the base 18 of the basin 12.

Various portions of the tub 10 may be covered with rubber or other cushioning material, e.g., the base 18 may be covered with rubber. Also, a headrest 52 (e.g., foam) may be provided on the rigid panel 16. One or more cushioned handles 54 (e.g., foam) may be provided on the guard 40. Also, one or more mesh bags 56 may be provided on the tub 10 to allow for storage of cleaning supplies and/or toys.

The tub 10 may be configured to fold into a compacted state. The guard 40 may be folded up against the rigid panel 16 to be in a stowed state. Cut-outs 58 may be provided along the rigid panel 16 to accommodate the guard 40 in the stowed state. In addition, the rigid panel 16 may be formed to the general outline of the side wall 20 so that the rigid panel 16 may be folded down onto the basin 12 with a matching footprint. Secondary cut-outs 60 may be provided in the basin 12 to accommodate portions of the guard 40 and/or the rigid panel 16. In addition, the legs 14 may be foldable to a collapsed state below the basin 12. A hollow 62 may be provided below the base 18 formed to accommodate the folded legs 14. With this arrangement, the tub 10 in a folded state is generally the size of the basin 12. Moreover, the mesh bag 56 may be located on an inner side of the rigid panel 16 so that in the folded state, the mesh bag 56, including the contents thereof are located within the basin 12. One or more rings or brackets 64 may be provided on the basin 12 for strapping for transporting and/or storage of the tub 10.

The tub 10 may be used with a child as he/she grows. For young infants (e.g. from birth to six months), the basin 12 may accommodate a foam bath mat. For older infants (e.g., from six months to twelve months), the basin 12 may accommodate a recliner bath seat. For toddlers and young children (e.g., from 1 year to four years), the basin 12 may accommodate the child directly with the guard 40 in a protective position as needed.

What is claimed is:

1. A freestanding, portable raised tub for infants, toddlers and young children, the tub comprising:

a basin with a base and an upstanding side wall bounding the base;

a plurality of legs secured to the basin;

a rigid panel pivotably connected to the basin to be angularly adjustable relative thereto; and, an adjustable guard pivotably connected to the rigid panel to be angularly adjustable relative thereto, the guard being elongated to extend continuously from a first location on the rigid panel to a second location on the rigid panel, the first and second locations being spaced apart, wherein the guard is angularly adjustable relative to the rigid panel between a first state, in contact with the rigid panel, and a safety position, where the guard and the rigid panel collectively bound a safety area spaced above the basin, the safety area being formed to generally overlay the base.

2. A tub as in claim 1, wherein the legs are adjustable in length.

3. A tub as in claim 1, wherein the first and second locations are spaced away from the pivot connection between the rigid panel and the basin.

4. A tub as in claim 1, wherein the guard is U-shaped with a first side section, a second side section, and a third crosspiece section extending between the first and second side sections.

5. A tub as in claim 4, wherein the first side section is pivotably connected to the first location and the second side section is pivotably connected to the second location.

6. A tub as in claim 1, wherein the guard is angularly adjustable relative to the rigid panel to releasable fixed positions.

* * * * *